US006769752B2

(12) United States Patent
Hahn et al.

(10) Patent No.: US 6,769,752 B2
(45) Date of Patent: Aug. 3, 2004

(54) APPARATUS FOR DISPLAYING OBJECTS

(75) Inventors: Till Hahn, Frankfurt am Main (DE); Thomas Otto Hahn, Frankfurt am Main (DE)

(73) Assignee: Glasbau Hahn GmbH & Co. KG, Frankfurt am Main (DE)

( * ) Notice: Subject to any disclaimer, the term of this patent is extended or adjusted under 35 U.S.C. 154(b) by 53 days.

(21) Appl. No.: 10/170,093

(22) Filed: Jun. 12, 2002

(65) Prior Publication Data

US 2002/0185942 A1 Dec. 12, 2002

(30) Foreign Application Priority Data

Jun. 12, 2001 (DE) ..... 201 09 801

(51) Int. Cl.[7] ..... A47B 95/02
(52) U.S. Cl. ..... 312/319.7; 312/114; 312/139
(58) Field of Search ..... 312/114, 116, 312/137, 138.1, 139, 139.1, 327, 319.7

(56) References Cited

U.S. PATENT DOCUMENTS 297,271 A * 4/1884 Ladd et al. ..... 312/139
1,912,899 A * 6/1933 Johannsen ..... 312/114
1,920,882 A * 8/1933 Pellow ..... 312/114
4,572,598 A * 2/1986 Moore, Jr. ..... 312/284
D304,641 S * 11/1989 Bourassa ..... D99/5
4,920,760 A * 5/1990 Muhlack ..... 312/284
5,558,416 A * 9/1996 Dumitru ..... 312/139
5,755,496 A * 5/1998 Hahn ..... 312/139

FOREIGN PATENT DOCUMENTS

GB 2278995 * 12/1994 ..... 312/114
JP 04187109 * 7/1992 ..... 312/114

* cited by examiner

*Primary Examiner*—Lanna Mai
*Assistant Examiner*—Hanh V. Tran
(74) *Attorney, Agent, or Firm*—Bucknam and Archer

(57) ABSTRACT

Apparatus for displaying objects having a lower part fixed to an underframe and an upper part pivotally attached to the lower part. The upper part includes front, rear, right, left and upper side parts, of which at least the upper side part consists of a glass pane and wherein the upper part can be moved by an electric motor.

6 Claims, 3 Drawing Sheets

APPARATUS FOR DISPLAYING OBJECTS

This innovation relates to an apparatus for displaying objects, with a lower part fixed to an underframe and an upper part which is pivotally attached to the lower part and comprises front, rear, right left and upper side parts, of which at least the upper side part consists of a glass pane.

Such an apparatus is already known. Thus a display cabinet for displaying objects is described in DE 195 13 151 C1, which consists of a lower part and an upper part which is downwardly open and comprises at least a rear side surface, a front side surface, left and right side surfaces and an upper surface, of which the front, left and right side surfaces and the upper surface consist for example of glass, the upper part being pivotally attached to the lower part.

In this known display cabinet the upper part is held in the open position by one or two gas springs, each fitted in the region of the side surfaces, namely on the lower part at one end and on the upper part at the other end. The gas springs also facilitate opening the display cabinet. However a disadvantage is that the selection of the particular gas springs, whose force depends on the weight of the upper part. Furthermore the use of gas springs to compensate for the weight of the upper part is always a problem when the interior of the display cabinet is to be hermetically sealed from the ambient air when the display cabinet is closed, since—although a surrounding sealing strip is present on the underside of the upper part or on the upper side of the lower in the edge region, the gas springs counteract the weight of the upper part and thus prevent reliable seating of the upper part on the lower part, unless additional measures are taken to ensure that an airtight connection is ensured between the upper part and the lower part in the closed condition of the display cabinet.

The object of the innovation lies in providing a display cabinet in which gas springs can be dispensed with but which is easy to open and close, while an airtight connection between the upper part and the lower part is ensured.

In this way, by using suitable means in conjunction with an electric motor, the upper part can easily be swung up from the lower part and on the other hand can be likewise moved on to the lower part again in the closing operation of the display cabinet, and so far in fact that an airtight connection results again between the upper part and the lower part.

Further advantages appear from the dependent claims.

The innovation will be explained in more detail with reference to an embodiment, which is shown in the drawings, wherein.

Figure 1:
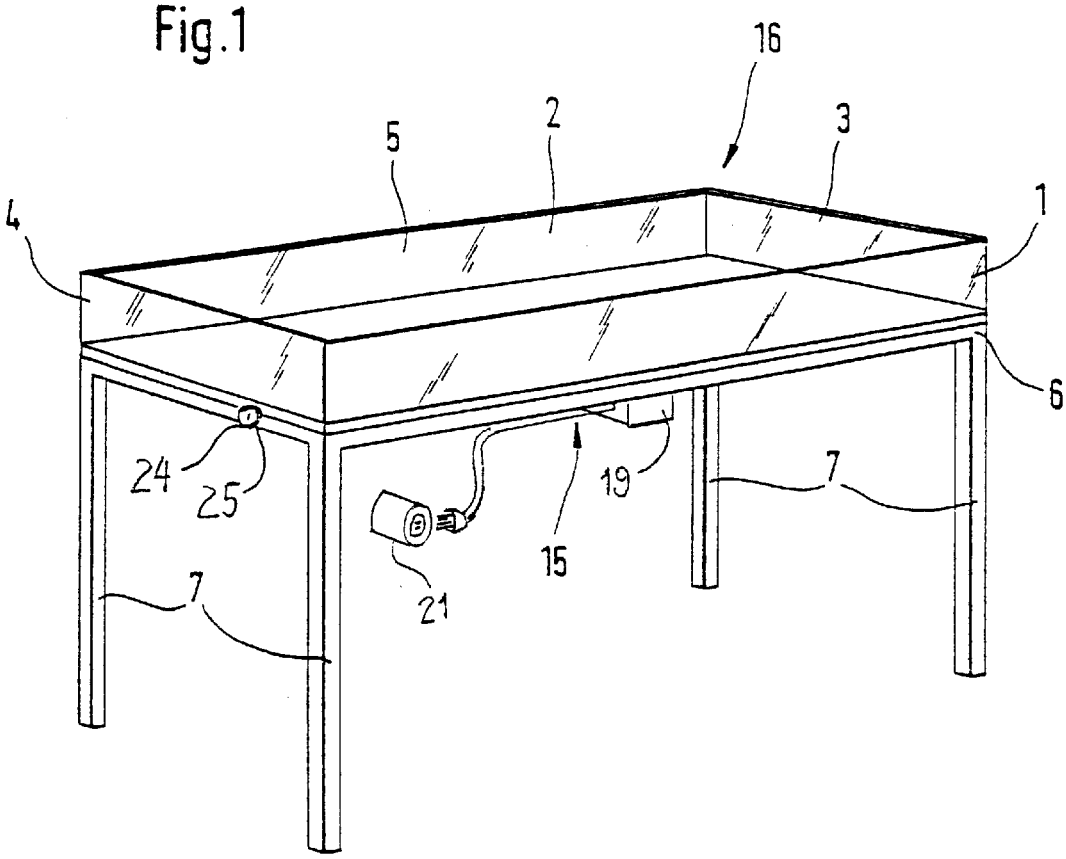
FIG. 1 is a perspective view of a table display cabinet.

A table display cabinet according to FIG. 1 comprises an upper part 16, which consists of front 1, rear 2, right 3 and left 4 side surfaces and an upper side surface 5 and is movably attached to a lower part 15. All of the side surfaces—in any case at least the upper side surface 5—consist of glass panes. The space bounded by the side panes 1 to 5 serves to protect more or less flat display objects, e.g. in museums. In order to facilitate access to the display objects, the upper part 16 pivotally mounted in the region of one of the side surfaces 2 to 4 can be moved up within a certain range (see FIG. 2). The lower part 15 can consist of an underframe 6 provided with legs 7 or of a closed cube-form block.

Figure 2:
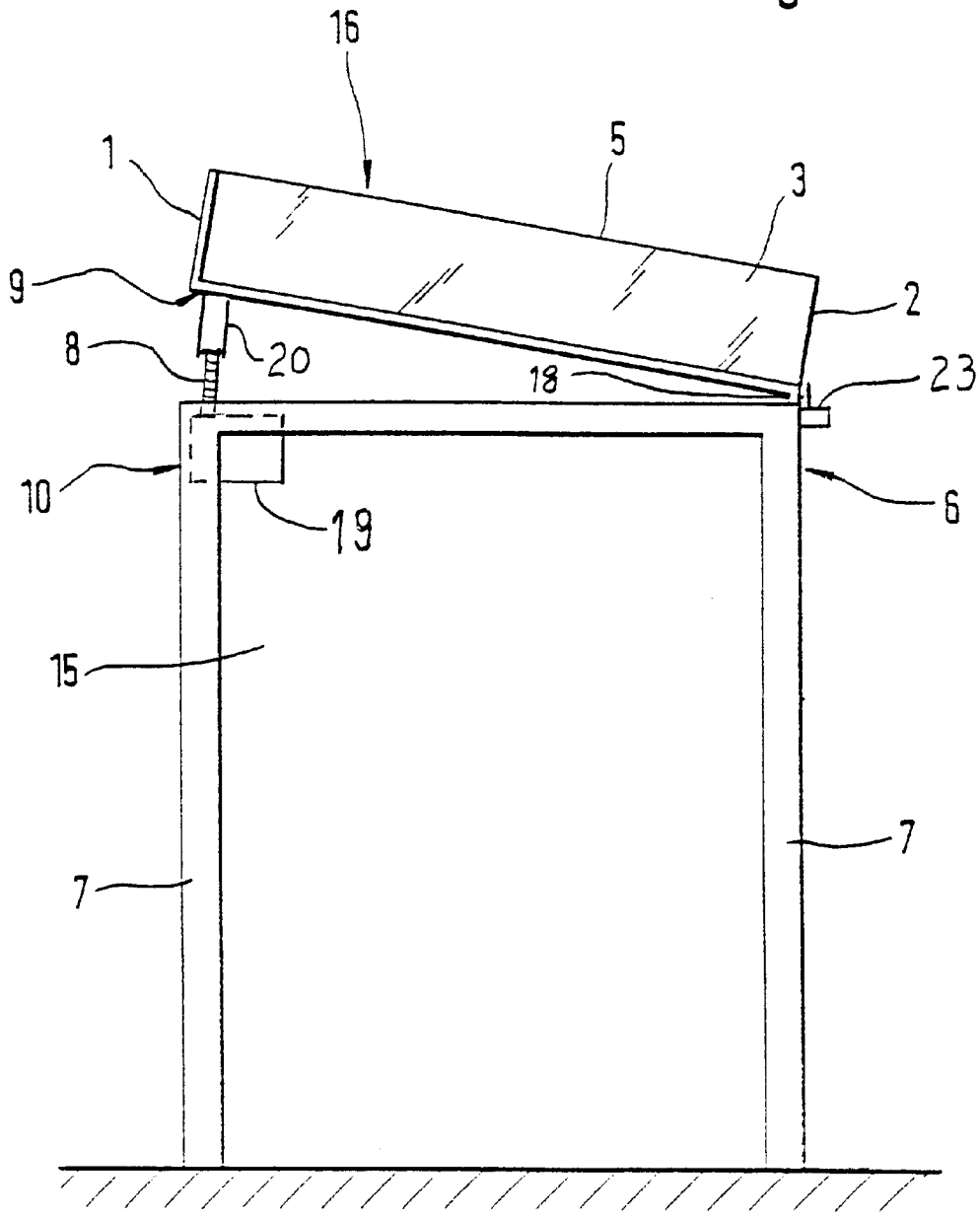
FIG. 2 is a side view with the upper part opened.
Figure 3:
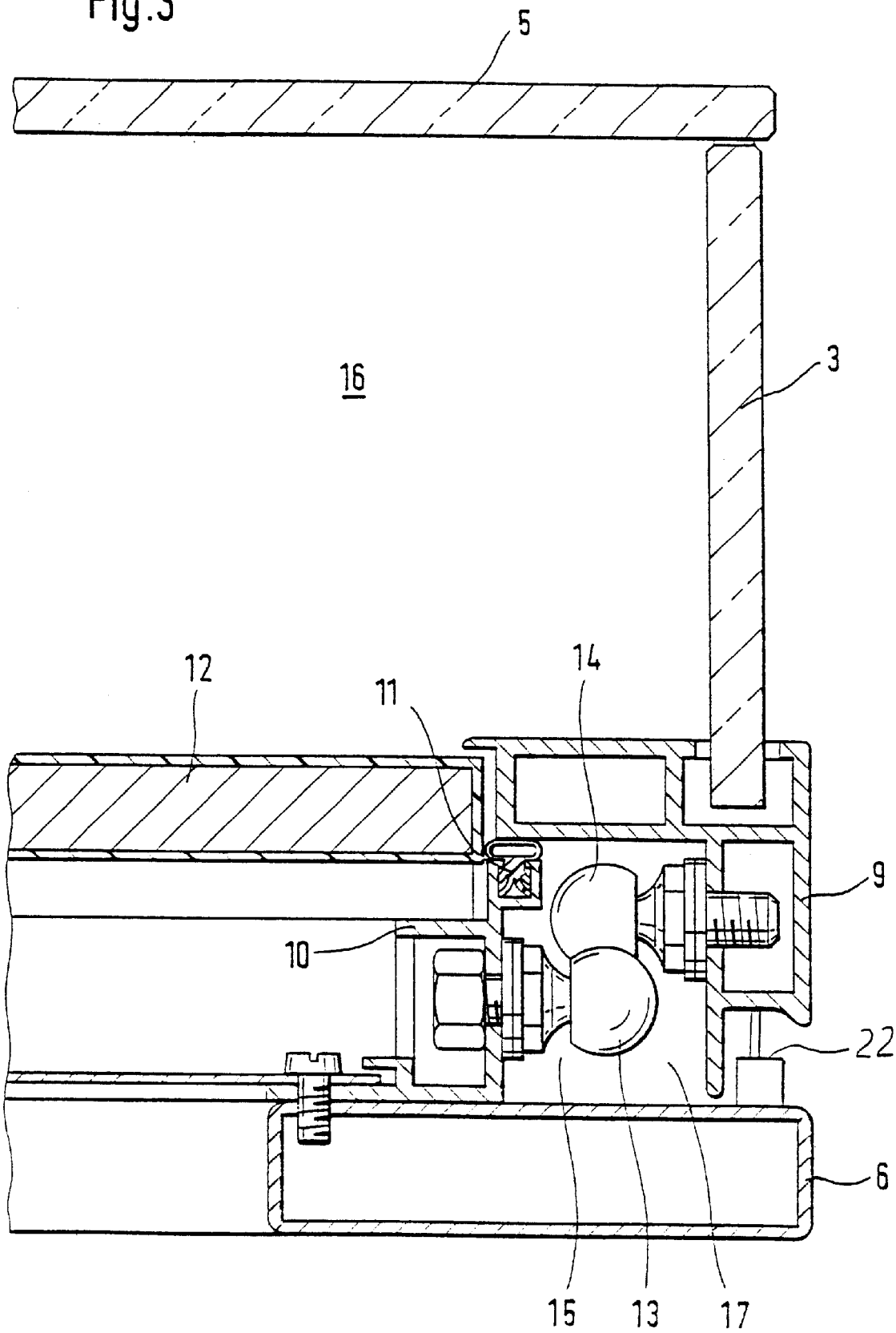
FIG. 3 is a cross-section through the upper and lower parts in the closed state of the display cabinet.

As is shown in FIG. 3, the side panes 1 to 4 of the upper part 16 are each held in an upper frame 9 in the region facing the lower part 15, this frame being formed from extruded metal profiles. There is a lower frame 10 also consisting of extruded metal profiles in register with the upper frame 9, which forms the lower part 15 and is fixed to the underframe 6. In the closed state of the upper part 16, i.e. when this lies on the lower part 15, the frames 9 and 10 are in register with one another. Depending on the form and size of the table display cabinet, there are one or more hinges 18 (see FIG. 2) either in the region of the rear side surface 2 or one of the two side surfaces 3 or 4, each hinge being fitted on the upper frame 9 or on the rear edge of the upper side part 5 and on the lower frame 10, so as to make possible the ability of the upper part 16 to pivot Opening of the upper part 16, i.e. swinging this up, and also closing, i.e. lowering of the upper part 16 on to the lower part 15 is effected by an electric motor 19 which is fitted in the lower part 15 or in the lower frame 10 and drives an adjusting mechanism, for example a thrust member 8 (FIG. 2). The electric motor together with the push member 8 can be fitted in the region of the front side part 1 (see FIG. 1 or 2), preferably in the middle or even in the region of the right or left side part 3 or 4. The thrust member 8 is movably connected to the upper frame 9 about the transverse axis at its end remote from the electric motor. When the electric motor is operated by a voltage with a suitable polarity, its rotary movement is converted by connected means, not shown, into a thrust movement which acts on the thrust member 8 and thus raises the upper part 16 from the lower part 15, in particular to the extent allowed by the maximum extensible length of the thrust member 8. In order to lower the upper part 16 on to the lower part 15 the direction of rotation of the electric motor is changed by corresponding reversal of the polarity of the voltage.

Another possibility for constructing an adjusting mechanism can be that the motor 19 drives a threaded spindle 8 with an external thread, which is in a threaded sleeve 20 with an internal thread. The electric motor 19, which is rigidly connected to the threaded spindle 8, is movably connected to a first fixing point 13 on the lower frame 10 about the transverse axis in a chamber 17 (see FIG. 3) which is formed through suitable formation of the two metal profiles of the upper and lower frames 9 and 10 respectively, when they lie together. The threaded sleeve 20 is movably connected at its end remote from the electric motor 19 to a second fixing point 14 of the upper frame 9, likewise movable about the transverse axis. When both frames 9 and 10 lie together the spacing from one another between the two fixing points 13 and 14 amounts to the spacing between the end of the electric motor remote from the threaded spindle and the end of the threaded sleeve remote from the electric motor 19 in the state of rest of this adjusting mechanism. In order to seal the interior of the upper part 16 in the closed state of the display cabinet, a surrounding elastic sealing strip 11 is provided in the lower frame 10 and bears on the upper frame 9.

If the electric motor/adjusting mechanism is self-locking, it is possible not only to dispense with a retaining device for the upper part 16 in the open state but also with installation of a cylinder lock in the lower frame 10, especially when the electric motor obtains its power through an externally connectible current supply device 21 which only has to be connected when the upper part of the table display cabinet is to be opened or closed. If a cylinder lock 24 is provided an electric contact 25 operated by the cylinder lock must if required be present which is electrically connected to electric motor 19 and interrupts the circuit for the electric motor in the closed state. Other contacts can further be provided which interrupt the current supply for the electric motor 19 in the direction of rotation in question as soon as the adjusting mechanism had reached one of its two end positions. Thus, a contact 22 (FIG. 3) is electrically connected to the electric motor (19) to interrupt the electric motor circuit when the upper part (16) reaches a closed position on the lower part (15) and a contact (23) (FIG. 2) is electrically connected to electric motor (19) to interrupt the electric motor circuit when the upper part (16) reaches the open position relative to lower part (15).

It is also conceivable to connect the current supply device constantly and to cause the opening and closing of the display cabinet by actuation of corresponding contacts. If the adjusting mechanism is also self-locking in the closed state of the display cabinet and a cylinder lock can accordingly be dispensed with, there is the possibility in the case of a fire to trigger automatic opening of one or more display cabinets by a fire alarm system through automatic closure of suitable contacts. This ensures that the objects in the display cabinets can be taken to safety quickly in the case of a fire.

What is claimed is:

1. Apparatus for displaying objects, comprising:

a lower part (15) fixedly attached to an under frame (6), said lower part including a lower frame (10) formed of metal profiles;

an upper part (16) comprising front (1), rear (2), right (3), left (4) and upper (5) side parts and including an upper frame (9) formed of metal profiles wherein said front, rear, right and left side parts are held in said upper frame on sides of said side parts facing away from said upper side part, said upper part being pivotally attached to said lower part; and an electric motor (19) mounted to said lower frame (10) and adapted to drive a threaded spindle (8) which is surrounded by a threaded sleeve (20) connected at a free end to said upper frame (9) so as to move said upper part (16) pivotally with respect to said lower part (15) wherein the metal profiles of said upper frame (9) and said lower frame (10) form a chamber (17) in the closed position of said upper part (16) with respect to said lower part (15) for housing a first fixing point (13) of the lower frame and a second fixing point (14) of the upper frame.

2. The apparatus for displaying objects as defined in claim 1, wherein said electric motor (19) is supplied by a current source (21) connectible from outside said apparatus.

3. The apparatus for displaying objects as defined in claim 1, wherein a first fitted contact (22) interrupts the electric motor circuit for the closing operation when said upper part (16) reaches a closed position on said lower part (15).

4. The apparatus for displaying objects as defined in claim 3, wherein a second fitted contact (23) interrupts the electric motor circuit for the opening operation when said upper part (16) reaches on open position relative to said lower part (15).

5. The apparatus for displaying objects as defined in claim 1, wherein said threaded spindle (8) and said threaded sleeve (20) are fixedly engaged with each other when said electric motor is in the switched off state so as to be self-locking.

6. The apparatus for displaying objects as defined in claim 1, which further includes a cylinder lock (24) in the lower frame so as to prevent opening of said upper part with respect to said lower part in the locked state, and an electric contact (25) activated by said cylinder lock in the locked state for interrupting the electric motor circuit.

* * * * *